United States Patent [19]

Reuter et al.

[11] Patent Number: 4,750,541

[45] Date of Patent: Jun. 14, 1988

[54] LIFTING MECHANISM FOR CASTING MOLDS

[75] Inventors: Wolfgang Reuter, Niddatal; Manfred Hartmann, Gelnhausen, both of Fed. Rep. of Germany

[73] Assignee: Leybold-Heraeus GmbH, Cologne, Fed. Rep. of Germany

[21] Appl. No.: 881,631

[22] Filed: Jul. 3, 1986

[30] Foreign Application Priority Data

Mar. 14, 1986 [DE] Fed. Rep. of Germany ..... 3608587

[51] Int. Cl.[4] ..... B22D 27/04

[52] U.S. Cl. ..... 164/412; 164/338.1

[58] Field of Search ..... 164/122, 122.1, 122.2, 164/130, 136, 412, 258, 338.1

[56] References Cited

U.S. PATENT DOCUMENTS 3,690,367 9/1972 Daniels ..... 164/136
3,897,815 8/1975 Smashey ..... 164/122.1

FOREIGN PATENT DOCUMENTS 58-209447 12/1983 Japan ..... 164/412
831353 5/1981 U.S.S.R. ..... 164/412

*Primary Examiner*—Nicholas P. Godici
*Assistant Examiner*—Richard K. Seidel
*Attorney, Agent, or Firm*—Felfe & Lynch

[57] ABSTRACT

Lifting mechanism for casting molds in precision founding furnaces with a melting facility disposed in a melting chamber and a transfer chamber disposed below the melting chamber. The lifting mechanism has a mold table centrally disposed below the casting mold with a lifting rod and a vertical guiding mechanism. The driving mechanism for the lifting rod comprises a rapid driving mechanism and a precision driving mechanism which is connected in series with the rapid driving mechanism. At the vertical guiding mechanism, a carriage is guided, which can be moved by the rapid driving mechanism into at least two specifiable positions. The precision driving mechanism is mounted on the carriage and can be raised and lowered together with said carriage and is connected to the lifting rod of the mold table.

5 Claims, 2 Drawing Sheets

A
1
5
8a
7
6
2
4
9
10
3
11
12
13
27
8
26
14
36
37
17
30
20
28
30
24
19
35
29
16
23
39
25
22
38
34
31
21
32
18
15
33
A

LIFTING MECHANISM FOR CASTING MOLDS

The invention relates to a lifting mechanism for casting molds in precision founding furnaces with a melting facility disposed in a melting chamber and a transfer chamber, disposed below the melting chamber, for putting the casting molds into the chamber and for taking them out, the lifting mechanism having a mold table, centrally disposed below the casting mold, with a lifting rod and a vertical guiding mechanism as well as a driving mechanism.

Through U.S. Pat. No. 3,532,155, the German Offenlegungsschrift 2,135,159 and the German Offenlegungsschrift No. 3,220,744, precision founding furnaces with lifting mechanisms of the initially described type are known. For the known lifting mechanisms, the driving mechanisms are single-stage in construction and comprise either very long hydraulic cylinders, which appreciably increase the overall height of the precision founding furnaces (U.S. Pat. No. 3,532,155 and German Offenlegungsschrift No. 2,135,159), or the lifting mechanism is at the side, next to the path of motion of the casting mold (German Offenlegungsschrift No. 3,220,744). Admittedly, with single-stage hydraulic lifting mechanisms, rapid movements of the casting mold can readily be carried out; it is, however, very difficult, and not at all straight forward, to carry out a continuous, slow lowering motion, as is required, for example, for the "directional solidification", for which the casting mold, initially still filled with melt, must be moved out of a heating facility with continuous migration of the solidifying boundary. During such a slow motion, the hydraulic driving system tends to vibrate and the vibrations can interfere permanently with the process of "directional solidification". With mechanical driving mechanisms, it is exceedingly difficult to cover a large range of speeds. Here also, it is exceedingly difficult or practically impossible to work without vibrations in the range of low lowering speeds.

It is therefore an object of the invention to provide a lifting mechanism of the initially described type, with which very different movement speeds are possible and which nevertheless can work without vibrations in the range of slow lowering speeds.

This objective is accomplished inventively for the initially described lifting mechanism owing to the fact that the driving mechanism comprises a rapid driving mechanism, which is connected in series with a precision driving mechanism, that a carriage, which can be moved by the rapid driving mechanism into at least two specifiable positions, is guided on the vertical guiding mechanism, and that the precision driving mechanism is mounted on the carriage, together with which it can be raised and lowered, and is connected with the lifting rod of the mold table.

With the inventive solution, it is possible to move the carriage first of all by means of the rapid driving mechanism into one of at least two specifiable positions, preferably two positions, namely the highest position and a low position of the carriage. Starting out from these positions, the lifting rod is then adjustable by means of the precision driving mechanism, this lifting mechanism being designed for a slow floating speed, so that a vibration-free, continuous adjustment of the lifting rod and therefore of the casting mold is possible. By these means, it is possible to lower the casting mold slowly and without vibrations, especially during the "directional solidification" segment of the process, so that the migration of the solidifying front through the melt is not adversely affected.

In a further development of the invention, it is particularly advantageous if the vertical guiding mechanism comprises at least two parallel guiding columns, which are mounted on a reference platform, which is disposed below the transfer chamber, and if the rapid driving mechanism is connected, on the one hand, with the reference platform and, on the other, with the carriage guided on the guiding columns. The guiding columns are moreover connected rigidly over the reference platform with the precision founding furnace or with its transfer chamber, so that vibrations can be suppressed already during their development phase.

Further advantageous delopments of the object of the invention may be inferred from the dependent claims; their advantages are explained more closely in the detailed description.

Two examples of the operation of the object of the invention are explained in greater detail below by means of FIGS. 1 and 2.

Figure 1:
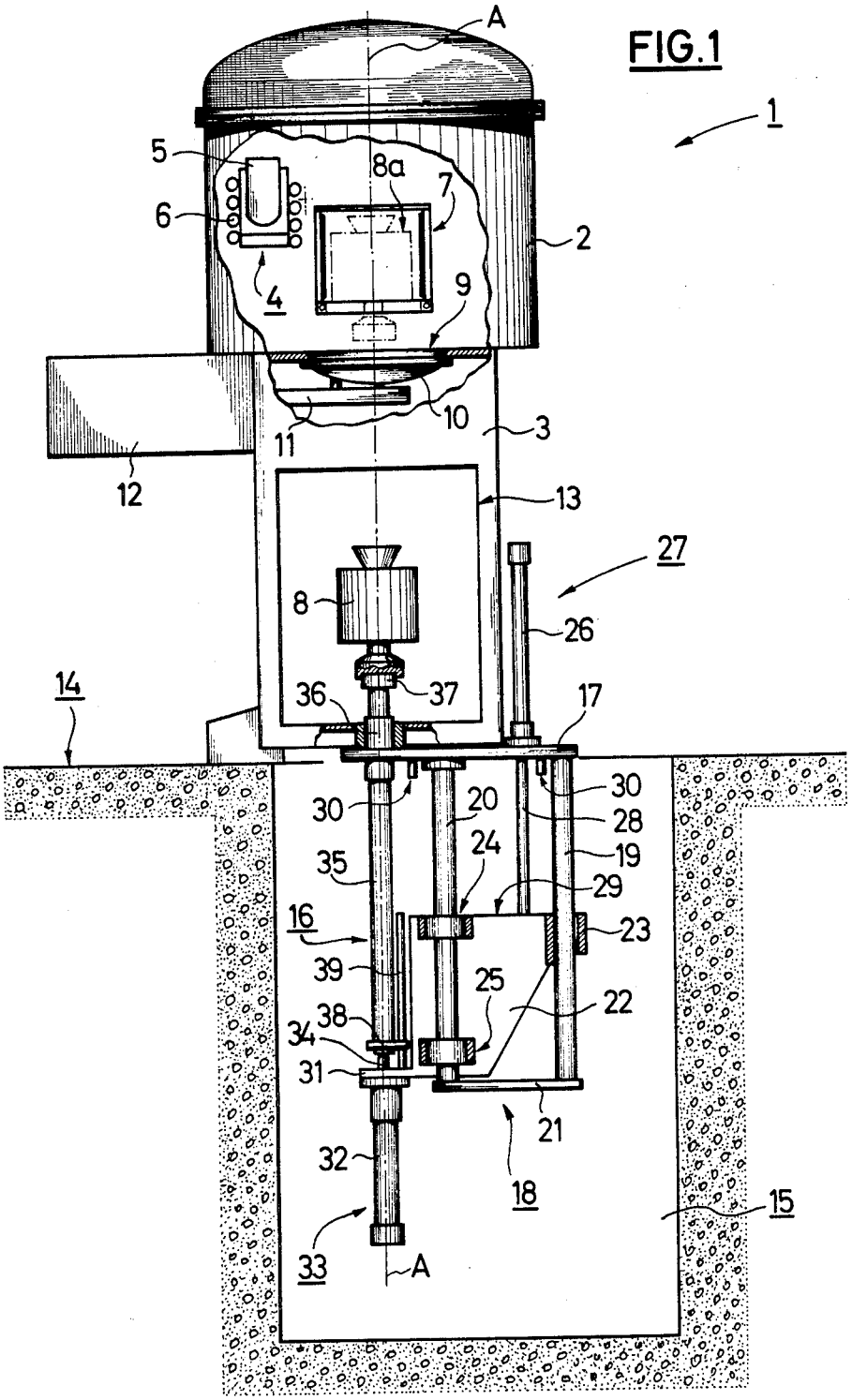
FIG. 1 shows a side view, partially cut open, of a complete precision founding furnace with the inventive lifting device.

In FIG. 1, a precision founding furnace 1 is shown, which has a melting chamber 2, below which a transfer chamber 3 is disposed. The precision founding furnace can be operated under vacuum and/or under an inert gas and has a furnace axis A—A, which determines the placement or alignment of the component parts, which are still to be described below.

In the melting chamber 2, there is a melting facility 4, which comprises, for example, a tiltable melting crucible 5, which is surrounded by an induction coil 6. The melting crucible 5 can be tilted in the direction of the furnace axis A—A, so that its contents can be discharged essentially in the direction of this axis.

At the side, below the melting device 4, there is a heating facility 7, which is open at the top and bottom and which also serves for implementing a directional solidification in this casting mold 8. For this purpose, the casting mold 8 can be lifted out of its position in the transfer chamber 3 into position 8*a*, within the heating facility 7, the latter position being indicated by a dot-dash line.

Melting chamber 2 and transfer chamber 3 are connected to each other by an appropriately dimensioned opening 9, which can be closed off by means of a valve plate 10, in order to maintain the atmosphere in the melting chamber 2. To unblock the opening 9, the valve plate 10 can be pulled back by means of an extensive arm 11 into a valve chamber 12, which is mounted on the side of the transfer chamber 3 The casting mold 8 can be taken from the transfer chamber 3 through a door 13, of which only the outline is shown here.

The transfer chamber 3 rests on a foundation 14, in which a pit 15 is disposed, the function of which is to hold the inventive lifting mechanism 16. This lifting mechanism includes a reference platform 17, which is affixed to the underside of the transfer chamber 3. The reference platform 17 carries a vertical guiding mechanism 18, which comprises two, parallel guiding columns 19 and 20, which are connected together at their upper ends by said reference platform 17 and at their lower ends by a cross arm 21. A vertically displaceable carriage 22 is guided on these guiding columns 19 and 20, and moreover by three bearings 23, 24 and 25, the positions of which form the corners of a triangle. Cylinder 26 of a rapid, hydraulic driving mechanism 27 is mounted on the reference platform 17. The piston rod 28 of the cylinder 26 is parallel to the guiding columns 19 and 20 and connected with the carriage 22. The carriage 22 can be moved in the manner indicated from the low position shown in FIG. 1 into the highest position, in which the upper edge 29 of the carriage 22 comes to rest against two stops 30.

In the region of its lower end, the carriage 22 has a supporting bracket 31, with which the cylinder 32 of a precision driving mechanism 33 is connected from below, the piston rod 34 of cylinder 32 being connected with a lifting rod 35. This lifting rod leads over a vacuum seal 36 into the interior of the transfer chamber 3, and carries at its upper end a mold table 37, on which the casting mold 8 is placed. The precision driving mechanism 33, the lifting rod 35 and the casting mold 8 are moreover aligned precisely coaxially with the furnace axis A—A. The rapid driving mechanism 27 and the precision driving mechanism 33 are connected kinematically in series, that is, their paths are additive, the rapid driving mechanism 27 being used essentially to bring about the necessary preliminary adjustment.

At its lower end, the lifting rod 35 is provided with a guide fork 38, which embraces a guide rod 39 in order to prevent twisting of the lifting rod 35.

Figure 2:
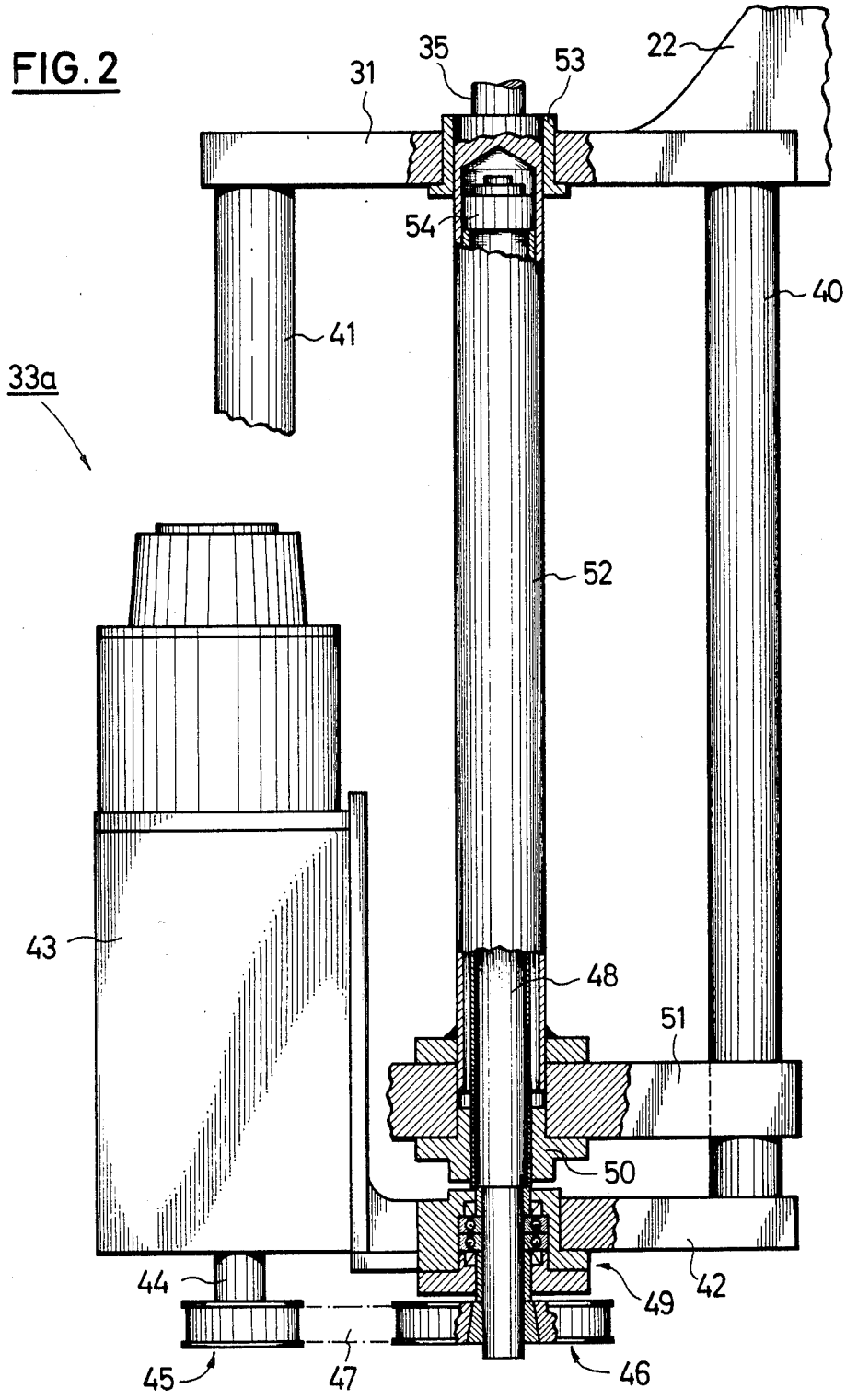
FIG. 2 shows a possible variation of a part of FIG. 1 on a larger scale.

In FIG. 2, the hydraulic precision driving mechanism 33 is replaced by an electric precision driving mechanism 33*a*. The construction of the supporting bracket 31 at the lower end of the carriage 22 is largely similar. On the underside, the supporting bracket 31 is connected with two additional guiding columns 40 and 41, of which column 41, on the left, is shown only partly. At their lower ends, the guiding columns 40 and 41 are connected to each other by a cross arm 42, at the left end of which an electric geared motor 43 is mounted. The geared motor 43 has a driving shaft 44 with a toothed wheel 45, which is connected over a toothed belt 46 with a further toothed wheel 46. The toothed wheel 46 at the right is mounted so that it cannot rotate on a threaded spindle 48, which is supported by means of a bearing 49 in the cross arm 42 so that it cannot be displaced axially. The threaded spingle 48 engages a spindle nut 50 which, in turn, is mounted on a guiding cross arm 51, which can be moved on the guide columns 40 and 41. Through rotation of the threaded spindle 48, the guiding cross arm 51 is thus moved up or down and, in so being moved, carries along a supporting column 52, which represents the elongation of the lifting rod 35. The supporting column 52 is guided in a bearing bushing 53, which is mounted in the supporting bracket 31. To prevent flapping of the threaded spindle 48, the latter is provided at its upper end with a guide bushing 54, which is supported radially against the hollow supporting column 52. The threaded spindle 48 is supported in this way at both ends, so that radial vibrations cannot occur.

We claim:

1. In a founding assembly, a lifting mechanism for casting molds in precision founding furnaces with a melting facility disposed in a melting chamber and a transfer chamber, disposed below the melting chamber, for receiving the casting molds into the transfer chamber and for allowing them to be taken out, the lifting mechanism comprising: a mold table having a lifting rod, having a lower end, centrally disposed below a casting mold, and a vertical guiding mechanism and a driving mechanism, wherein said driving mechanism comprises a rapid driving mechanism and a precision driving mechanism which is connected in series with said rapid driving mechanism, a carriage, which can be moved by said rapid driving mechanism into at least two specifiable positions, guided by said vertical guiding mechanism, said precision driving mechanism being mounted on said carriage and raisable and lowerable together with said carriage and connected to said lifting rod of said mold table.

2. A lifting mechanism as defined in claim 1, wherein said vertical guiding mechanism comprises a reference platform disposed below said transfer chamber, and at least two parallel guiding columns which are mounted on said reference platform, said rapid driving mechanism being connected to said reference platform and to said carriage guided on said vertical guiding mechanism.

3. A lifting mechanism as defined in claim 2, wherein, in the region of said lower end of said lifting rod, said carriage has a supporting bracket and said precision driving mechanism is connected to said supporting bracket and to said lifting rod.

4. A lifting mechanism as defined in claim 3, wherein said precision driving mechanism has a hydraulic cylinder mounted on said supporting bracket and a piston with a piston rod, which is connected directly to said lifting rod.

5. A lifting mechanism as defined in claim 3, wherein said precision driving mechanism has an electric motor and a driving spindle, which is driven by said motor, connected to said lifting rod and running coaxially with said lifting rod.

* * * * *